US010857687B1

(12) United States Patent
Laupan et al.

(10) Patent No.: US 10,857,687 B1
(45) Date of Patent: Dec. 8, 2020

(54) CARTON SIZER

(71) Applicants: William Richard Laupan, Ballwin, MO (US); Jacob Henry Laupan, Ballwin, MO (US)

(72) Inventors: William Richard Laupan, Ballwin, MO (US); Jacob Henry Laupan, Ballwin, MO (US)

( * ) Notice: Subject to any disclaimer, the term of this patent is extended or adjusted under 35 U.S.C. 154(b) by 0 days.

(21) Appl. No.: 16/515,992

(22) Filed: Jul. 18, 2019

(51) Int. Cl.
*B26B 27/00* (2006.01)
*B26B 29/06* (2006.01)

(52) U.S. Cl.
CPC ..... *B26B 27/005* (2013.01); *B26B 29/06* (2013.01)

(58) Field of Classification Search
CPC ... B31B 50/25; B31B 50/262; B31B 2247/00; B31F 1/08; B26B 29/06; B26B 27/005; B26D 3/08; B26D 3/085; B25H 7/04; B28D 1/225; B28D 1/226; G01B 3/20; G01B 3/205
USPC ..... 30/2, 365, 366, 293, 294, 355; 33/42
See application file for complete search history.

(56) References Cited

U.S. PATENT DOCUMENTS 226,622 A * 4/1880 Moody ..... B44C 7/027 30/365
762,673 A * 6/1904 Arnold ..... B25H 7/04 33/44
1,195,886 A * 8/1916 Wheeler ..... B25H 7/04 33/42
2,335,513 A * 11/1943 Hewitt ..... G01B 3/28 33/42
2,436,686 A * 2/1948 Coffey ..... B28D 1/26 33/42
2,512,235 A * 6/1950 Lankford ..... B43L 9/04 33/27.03
2,531,803 A * 11/1950 Caldwell ..... B25H 7/04 33/42
2,588,658 A * 3/1952 Plotnik ..... B25H 7/04 33/42
2,679,104 A * 5/1954 Whitton ..... B26D 3/085 33/42
2,695,447 A * 11/1954 Maynard ..... B26B 29/02 30/2

(Continued)

OTHER PUBLICATIONS

Carton Sizer/Reducer, 1/Each by Choice Shipping supplies (via amazon.com), downloaded on Jul. 17, 2017, Available from internet, <URL: https://www.amazon.com/Carton-Sizer-Reducer-1-Each/dp/B07R4XCRLL/ref=sr_1_26?keywords=carton+sizer&qid=1560881622&s=gateway&sr=8-26.

(Continued)

*Primary Examiner* — Jason Daniel Prone
(74) *Attorney, Agent, or Firm* — Brett A. Schenck

(57) ABSTRACT

A positioner for a carton sizer is provided. The positioner includes a housing and a latch. The housing houses the latch. The latch is pivotally connected to the housing. The latch may be pivoted between a latched position and an unlatched position. The positioner may be removably attached to a mast of a carton sizer at a selected height along the mast. The latch may engage the mast in the latch position to hold the positioner to the mast. The latch may disengage from the mast in the unlatched position. The carton sizer includes a handle and a cutter. The handle is connected to the mast. The positioner may engage a carton to provide support for the cutter against the carton during the cutting of the carton.

18 Claims, 9 Drawing Sheets

(56) References Cited

U.S. PATENT DOCUMENTS 2,763,065 A * 9/1956 Leidahl ..... G01B 3/06 33/485
2,797,492 A * 7/1957 Wright ..... B31B 70/00 493/405
2,818,644 A * 1/1958 Crawford ..... G01B 3/20 30/293
2,948,960 A * 8/1960 Eckstein ..... B26B 1/08 30/162
3,052,033 A * 9/1962 Studt ..... B25H 7/04 33/42
3,135,048 A * 6/1964 Daugherty ..... B65B 69/0033 30/2
3,137,068 A * 6/1964 Quigley ..... B65B 69/0033 30/2
3,191,295 A * 6/1965 Falk ..... B26D 3/085 30/2
3,239,932 A * 3/1966 Kramlich ..... B26D 1/147 30/2
3,286,351 A * 11/1966 McAlister ..... B25H 7/04 33/42
3,304,613 A * 2/1967 Shawhan ..... B26B 27/005 33/42
3,344,718 A * 10/1967 Schollard ..... B26D 1/147 493/354
3,664,025 A * 5/1972 Barto ..... B43L 9/04 33/27.03
3,871,100 A * 3/1975 Hildebrandt ..... B25H 7/04 33/42
D257,552 S * 11/1980 Sobol ..... 30/2
4,388,761 A * 6/1983 Henderson ..... B43L 13/028 33/42
4,483,071 A * 11/1984 te Kolste ..... B23Q 1/4804 30/376
4,520,571 A * 6/1985 Harding ..... B25H 7/04 33/42
4,799,315 A * 1/1989 Ziegler ..... B23Q 1/4809 30/293
4,809,439 A * 3/1989 Burns ..... B25H 7/04 33/42
4,825,549 A * 5/1989 Huang ..... B26B 27/005 30/2
4,858,327 A * 8/1989 Johns ..... B22D 11/16 33/42
4,916,820 A * 4/1990 Kozyrski ..... B26F 1/3846 225/96
4,979,304 A * 12/1990 Sprague ..... B26B 29/06 30/293
5,197,195 A * 3/1993 Aikens ..... B25H 7/04 30/293
5,265,342 A * 11/1993 Lang, Jr. ..... E04F 21/18 30/290
5,421,093 A * 6/1995 Davidson, Jr. ..... B25H 7/02 33/42
5,515,617 A * 5/1996 Canfield ..... B25H 7/04 33/42
D399,147 S * 10/1998 Tang ..... D10/70
5,915,806 A * 6/1999 Levee ..... B25H 7/04 33/42
6,467,174 B1 * 10/2002 Kotori ..... B26B 29/06 30/293
7,020,978 B1 * 4/2006 Nelson ..... B26B 29/06 33/760
7,178,246 B2 * 2/2007 McCallum ..... B26B 29/06 30/293
7,246,446 B2 * 7/2007 Adkins ..... B26B 29/06 33/42
7,269,906 B1 * 9/2007 Lee ..... B25H 7/04 33/42
7,370,426 B2 * 5/2008 Choi ..... B26B 29/06 33/42
8,272,136 B2 * 9/2012 Vogeler ..... B26B 29/06 30/286
D670,983 S * 11/2012 Buether ..... D8/14
8,434,235 B2 * 5/2013 Carter ..... B26B 29/06 30/293
2006/0242849 A1 * 11/2006 Fogal ..... B43L 13/028 33/42

OTHER PUBLICATIONS

Box Resizer (White) by Boxed master (via amazon.com), downloaded on Jul. 17, 2017, Available from internet, <URL: https://www.amazon.com/Boxed-master-Box-Resizer-White/dp/B07JW62MCT/ref=sr_1_31?keywords=carton+sizer&qid=1560881622&s=gateway&sr=8-31.

* cited by examiner

CARTON SIZER

FIELD

This application relates generally to a carton sizer.

BACKGROUND

There are certain situations needed in order to reduce the size of a carton. For example, the size of the carton may be larger than that of goods that may be shipped. Sometimes, filler material such as waste paper, air pillows, or packaging peanuts may be placed inside the carton to protect the goods during shipment. However, that increases the weight of the carton and thus, in addition to the larger size, the cost to ship it increases. There are tools called carton sizers that can resize the carton. The purpose of the carton sizer is to resize corrugated cartons to avoid needing excess infill and to save shipping costs due to dimensional weight calculations.

Carton sizers may benefit from improvements.

SUMMARY

In one aspect of the present invention, a positioner for a carton sizer is provided. The positioner includes a housing and a latch. The housing houses the latch. The latch is pivotally connected to the housing. The latch may be pivoted between a latched position and an unlatched position. The positioner is configured to be removably attached to a mast of a carton sizer at a selected height along the mast. The latch is configured to engage the mast in the latch position to hold the positioner to the mast. The latch may be configured to disengage from the mast in the unlatched position. The carton sizer includes a handle and a cutter. The handle is connected to the mast. The positioner is configured to engage a carton to provide support for the cutter against the carton during the cutting of the carton.

In another aspect of the present invention, a carton sizer is provided. The carton sizer includes a handle and a mast. The handle is connected to the mast. The carton sizer further includes a cutter and a positioner. The cutter is in operative connection with the mast and rotates relative to the mast. The positioner includes a housing and a latch. The housing houses a latch. The latch is pivotally connected to the housing. The latch may be pivoted between a latched position and an unlatched position. The positioner is removably attached to the mast at a selected height along the mast. The latch engages the mast in the latch position to hold the positioner to the mast. The latch may be disengaged from the mast in the unlatched position. The positioner is configured to engage a carton to provide support for the cutter against the carton during the cutting of the carton.

In another aspect of the present invention, a carton sizer is provided. The carton sizer includes a handle and a mast. The handle is connect to the mast. The carton sizer also includes a cutter and a positioner. The cutter is in operative connection with the mast. The cutter rotates relative to the mast. The positioner is removably attached to the mast at a selected height along the mast. The positioner includes a housing. The housing includes first and second legs. The first leg includes a first side. The second leg includes a second side. The first and second sides face each other. Each of the first and second sides include housing ribs. The mast includes mast ribs that extend along the mast. One or more of the housing ribs meshingly engage a selected one or more of the mast ribs at the selected height to help removably secure the positioner to the mast. The positioner is configured to engage a carton to provide support for the cutter against the carton during the cutting of the carton.

Other aspects of the disclosed invention will become apparent from the following detailed description, the accompanying drawings and the appended claims.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 2:
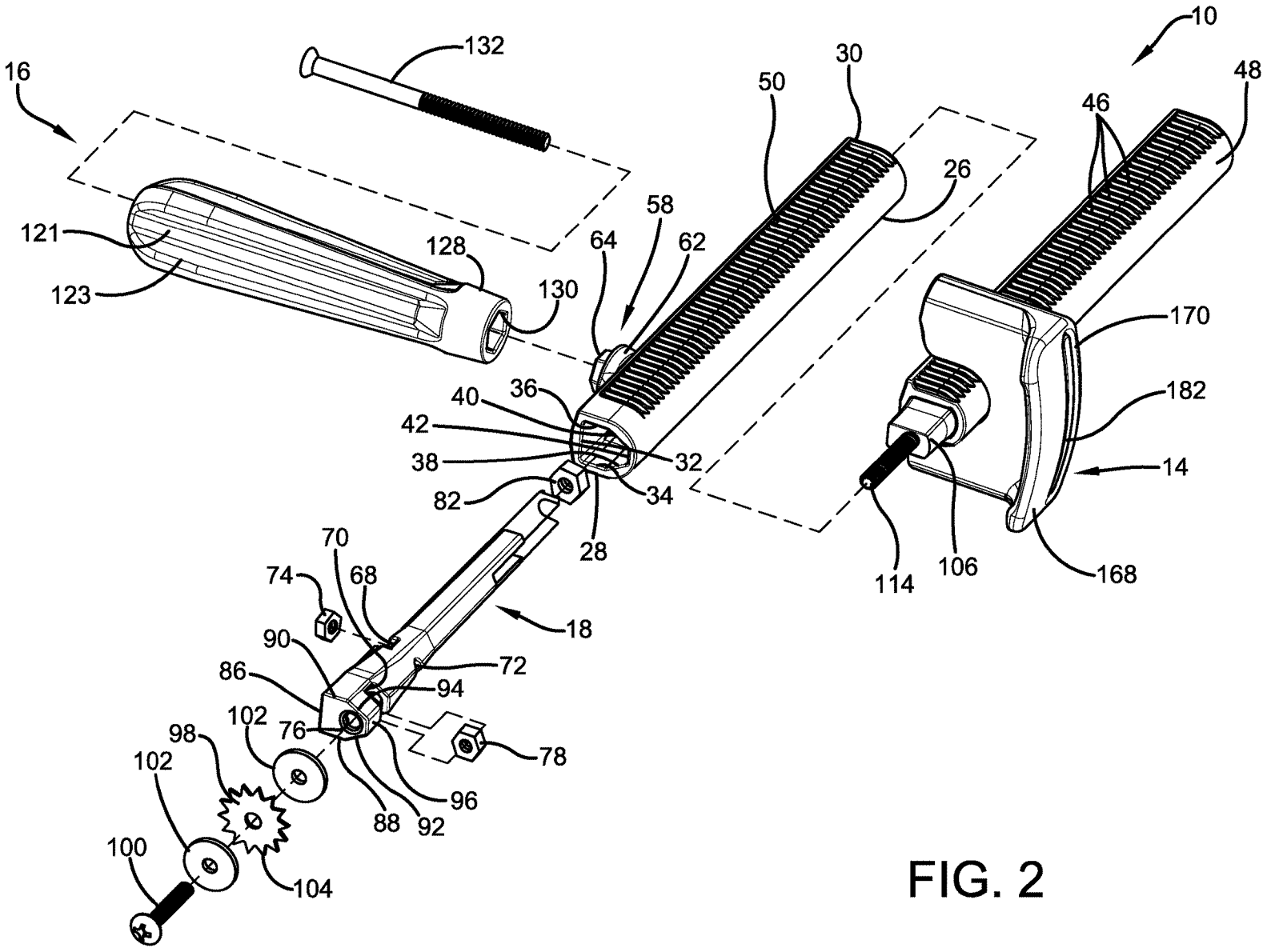
FIG. 2 is a front, left, and bottom partially exploded view of the first embodiment of FIG. 1.

Throughout the present description, the terms "upper", "lower", "top", "bottom", "left", "right", "front", "forward", "rear", and "rearward" shall define directions or orientations with respect to the carton sizer as illustrated in FIG. 2, which shows a front, left, and bottom partially exploded perspective view of the carton sizer 10. It will be understood that the spatially relative terms "upper", "lower", "top", "bottom", "left", "right", "front", "forward", "rear", and "rearward" are intended to encompass different orientations of the carton sizer in use or operation in addition to the orientation depicted in the figures. For example, if the carton sizer in the figures is turned over, elements described as "upper" elements or features would then be "lower" elements or features.

Figure 1:
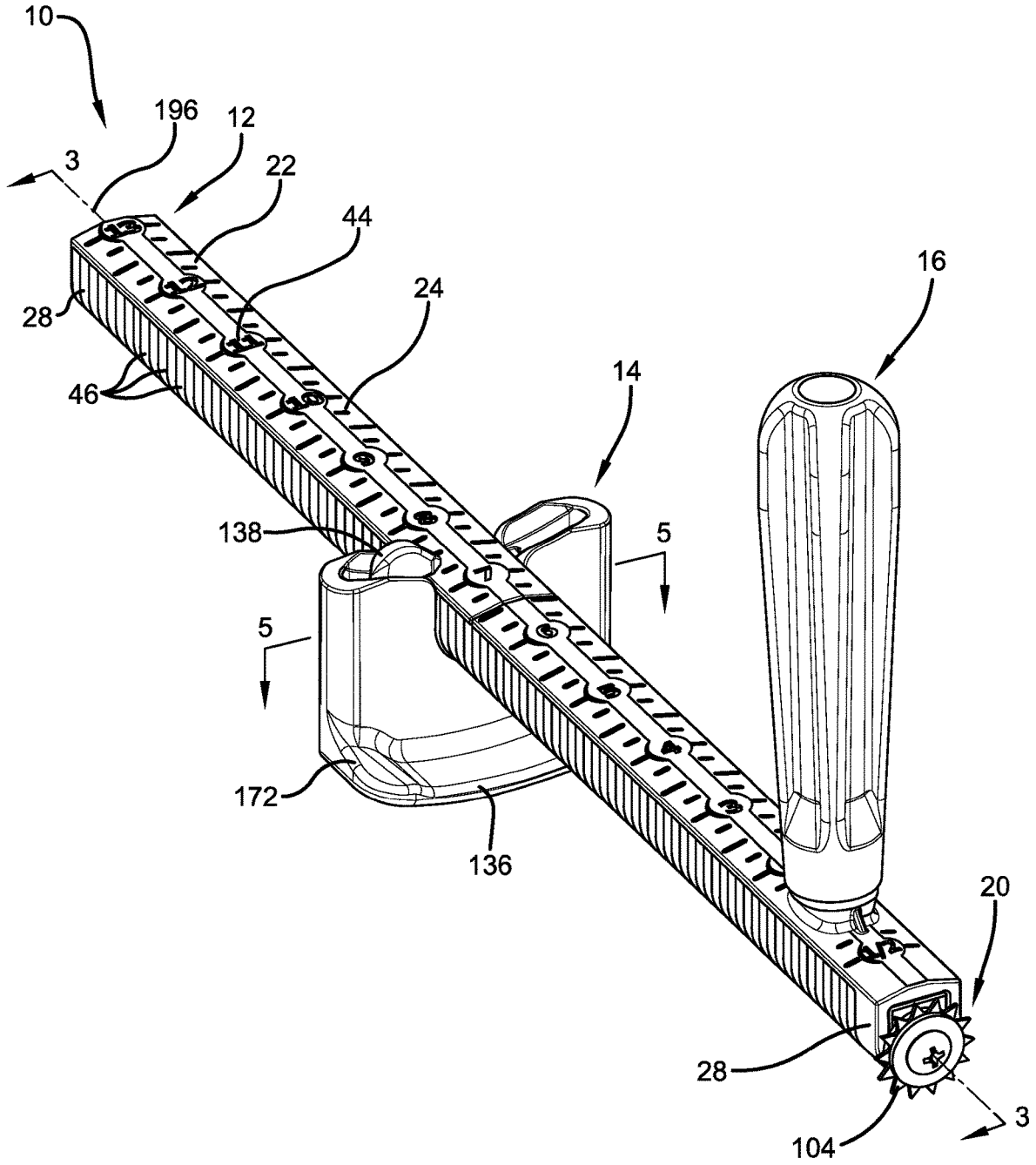
FIG. 1 is a bottom, rear, and right side perspective view of a first embodiment of the present invention.

As illustrated in FIGS. 1-6, a first exemplary embodiment is provided. This embodiment comprises a carton sizer 10. Referring to FIGS. 1 and 2, the carton sizer 10 comprises a mast 12, a positioner assembly 14, a handle 16, a nut block 18 (FIG. 2), and a cutter assembly 20. The mast 12 is generally hollow and has a casing 22. Referring to FIG. 2, the mast 12 may comprise an upper mast piece 48 and a lower mast piece 50 connected together. The casing 22 has an outer rear side 24 (FIG. 1), outer front side 26, and outer right and left sides 28, 30 that define generally an arch or a semi-race track shape. Specifically, the outer rear side 24 is generally straight bulging slightly in the middle and the outer front side 26 is convexly curved. The outer right and left sides 28, 30 are straight, parallel or generally parallel, and opposite to each other. The outer front side 26 joins their respective outer right and left sides 28, 30, which in turn join the outer rear side 24 at right angles. The casing 22 at the lower end of the lower mast piece 50 has an inner rear side 32, inner right and left sides 34, 36, inner right and left angled sides 38, 40, and an inner front side 42. The inner rear side 32 is straight and the inner right and left sides 34, 36 are straight, parallel, and opposite to each other. The inner right and left angled sides 38, 40 converge going in the forward direction to join the inner front side 42 at the front end of the casing 22. The inner right and left angled sides 38, 40 meet their respective inner right and left sides 34, 36, which in turn join the straight inner rear side 32 at right angles.

Figure 3:
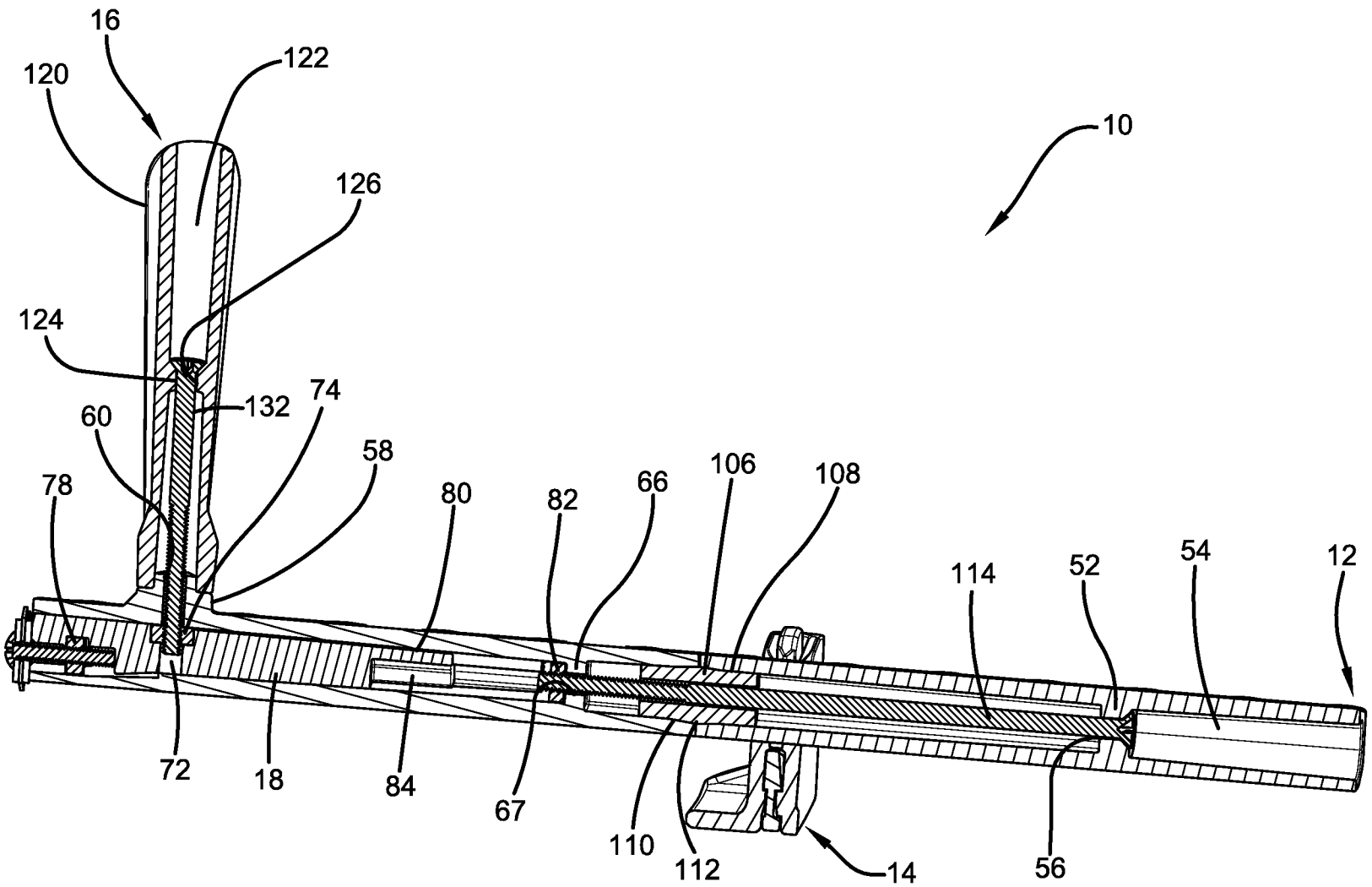
FIG. 3 is a sectional view taken along line 3-3 of FIG. 1.

As illustrated in FIG. 1, the outer rear side 24 of the mast 12 includes measurement indicia 44 molded therein corresponding to the height markings that face a user using the carton sizer 10. Each of the right and left outer sides 28, 30 have a plurality of lateral positioning ribs 46 that define splines molded therein. The mast ribs 46 are spaced longitudinally from each other along the mast going from the top of the mast 12 to near the bottom of the mast 12. Referring to FIG. 3, the upper mast piece 48 includes a lateral mounting plate 52 that extends across the interior space 54 in the upper mast piece 48. The mounting plate 52 has a central aperture 56 and is integrally formed in one piece with the upper mast piece 48. The lower mast piece includes a lateral boss 58 that extends rearwardly from the outer rear side 24. The boss 58 has a central aperture 60, front base 62 (FIG. 2) and a rear portion 64 (FIG. 2). The rear portion 64 has a hexagonal cross section that is also smaller than that of the front base 62. The lower mast piece 50 also includes a lateral mounting plate 66 near the upper end that extends across the interior space 54 in the lower mast piece 50. The mounting plate 66 has a central aperture 67 and is integrally formed in one piece with the lower mast piece 50.

Referring to FIGS. 2 and 3, the nut block 18 is generally elongated and comprises a rear recess 68 and a front recess 70 near the lower end of the nut block 18. The rear recess 68 includes a lateral aperture 72 that extends through the nut block 18. A locking nut 74 is seated in the rear recess 68 and aligned with the aperture 72. The nut block 18 further comprises a longitudinal aperture 76 that longitudinally extends upwardly from the lower end of the nut block 18 through the front recess 70 and partially into the upper end of the front recess 70. A locking nut 78 is seated in the front recess 70 and aligned with the longitudinal aperture 76. The nut block 18 further includes a u-shaped upper end portion 80. A locking nut 82 is placed upon the upper end portion 80 such that the locking nut 82 is aligned with the recess 84 defined by the upper end portion 80. As illustrated in FIG. 2, the cross section of the lower end of the nut block 18 is shaped to match the cross section of the opening in the lower mast piece 50 defined by the inner sides. In particular, the nut block 18 has a rear side 86, right and left sides 88, 90, right and left angled sides 92, 94 and a front side 96. The rear side 86 is straight and the right and left sides 88, 90 are straight, parallel, and opposite to each other. Right and left angled sides 92, 94 converge going in the forward direction to join the front side 96. The right and left angled sides 92, 94 meet their respective right and left sides 88, 90, which in turn join the rear side 86 at right angles.

The nut block 18 is fitted into the interior space 54 of the lower mast piece 50 and is held in place by any suitable way such as glue, friction via a press fit, or a mechanical fastener. When the nut block 18 is securely received by the lower mast piece 50, the mounting plate 66 bears upon the locking nut 82 on the upper end of the nut block 18 and the boss 58 is aligned with the locking nut 74 seated in the rear recess 68.

Figure 6:
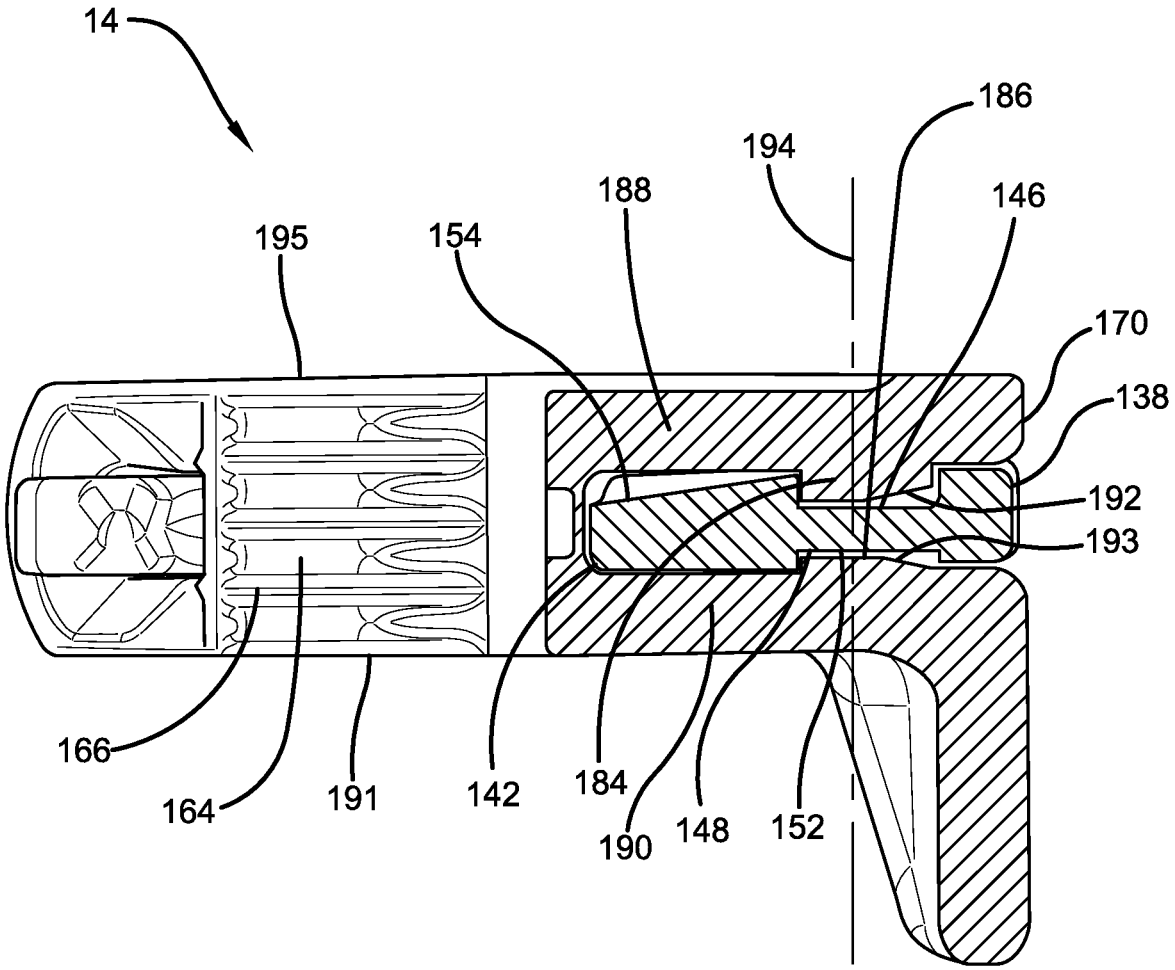
FIG. 6 is a sectional view taken along line 6-6 of FIG. 4A.
Figure 7:
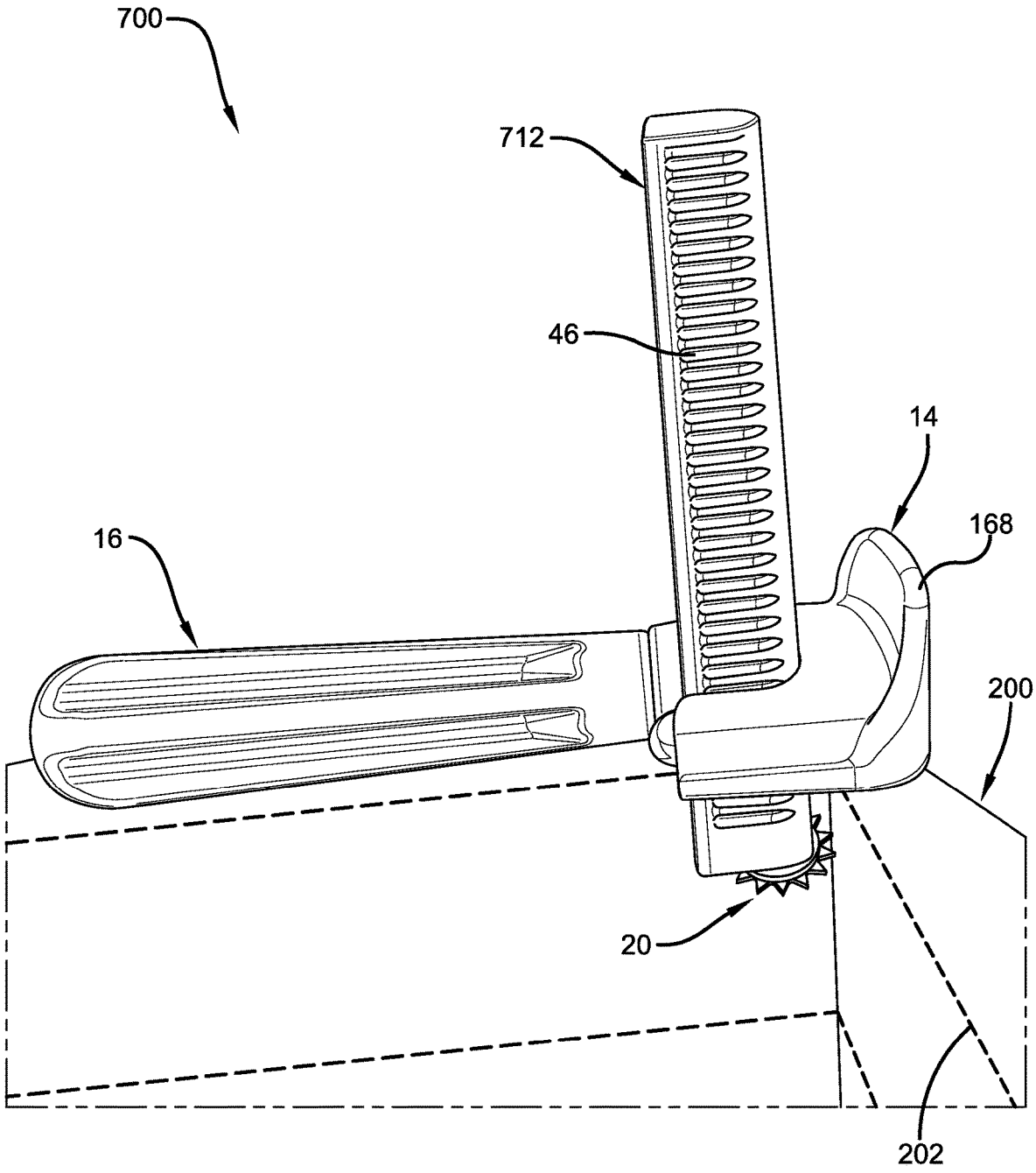
FIG. 7 is a left side perspective view of a second embodiment of the present invention and being used to cut a carton.

As seen in FIG. 2, the cutter assembly 20 includes a perforated disk 98, a machine screw 100, and one or more flat washers 102. The perforating disk 98 may also be part of another sub assembly where the disk 98 is mechanically connected (spot welded, welded, glued, etc.) between disc portions to form a stack. The perforated disk 98 may be made by metal stamping or laser cutting. A CNC machine may also be used in the process of making the perforated disk 98. The cutter assembly 20 is assembled to the lower end of the nut block 18. In particular, the machine screw 100 extends through the perforated disk 98, washers 102 and longitudinal aperture 76 and is secured to the nut block 18 by the locking nut 78 threadily engaging the machine screw 100. The machine screw 100 is dimensioned to allow the perforated disk 98 to freely spin. The teeth 104 of the perforated disk 98 extend beyond the outer front side 26 of the mast 12 as seen in FIGS. 1, 6, and 7.

As seen in FIG. 2, the longitudinal aperture 76 is offset forwardly from the central longitudinal axis of the nut block 18. This location and the curved outer front side 26 of the mast 12 allows the teeth 104 of a relatively small perforated disk 98 to extend beyond the mast 12 at the outer front side 26 and still perform the cutting. By contrast, if the longitudinal aperture 76 is at the center of the nut block 18 and the mast has a straight outer front side, the perforating disk 98 would need to have a larger diameter in order for the teeth to extend beyond the mast to perform cutting. This is advantageous, since with a smaller diameter, the perforated disc can better fit into the corners of carton to perform the cutting at the corners of the carton.

Figure 5:
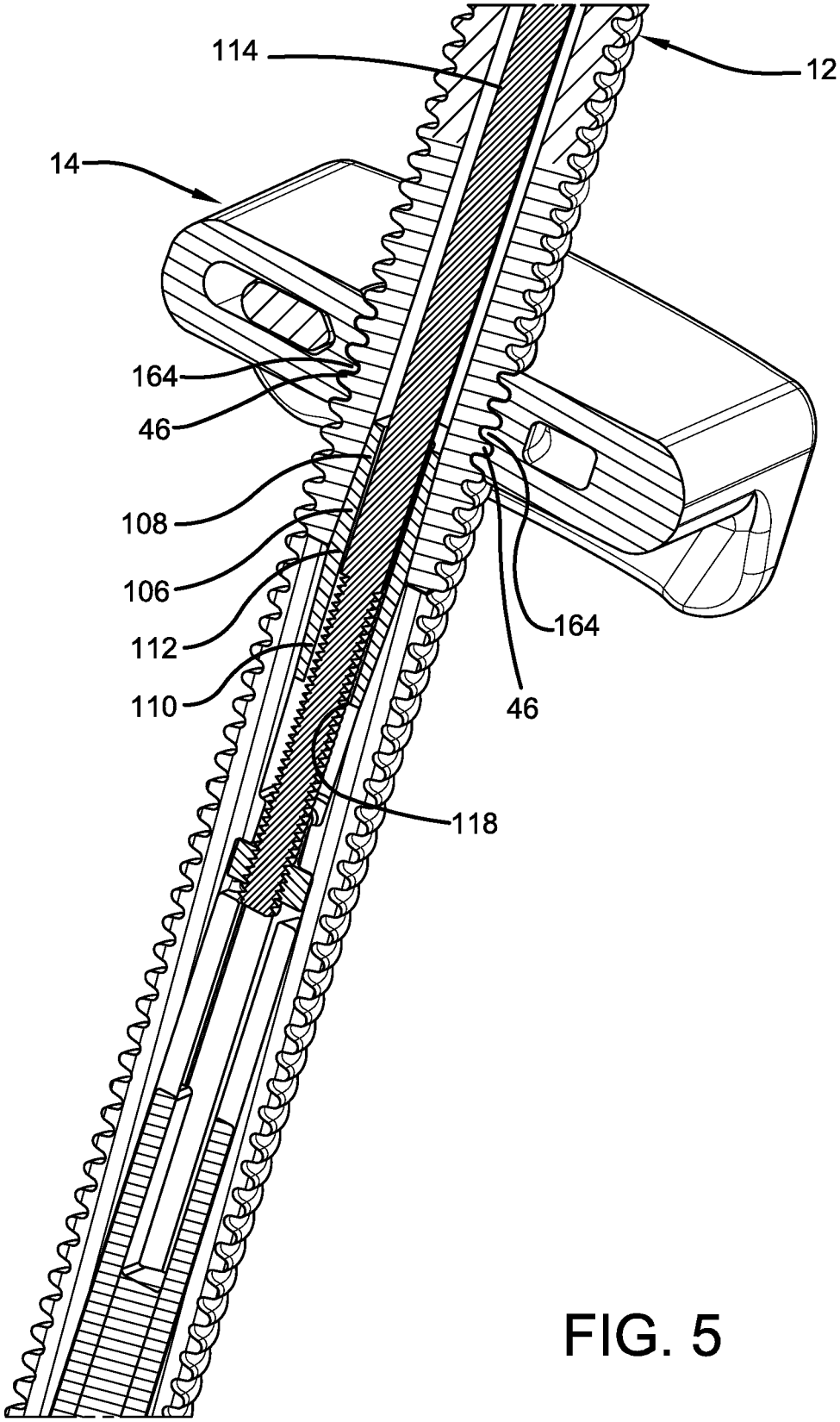
FIG. 5 is a sectional view taken along line 5-5 of FIG. 1.

As seen in FIGS. 2, 3 and 5, the upper mast piece 48 is securely connected to the lower mast piece 50. Specifically, a joint block 106 is provided that has a non-circular cross section that matches the shape of the cross section of the upper mast piece 48 and the upper end of the lower mast piece 50. The joint block 106 also tapers or converges at its upper and lower axial ends 108, 110. The axial ends 108, 110 are smaller than the cross sectional area of the interior space 54 of the mast, but the central portion 112 of the joint block 106 is larger than the cross sectional area of the interior of the mast. This allows the joint block 106 to be press fitted into the lower mast piece 50 and upper mast piece 48. A mast screw 114 is extends through the apertures 56, 67 of the mounting plates 52, 66 and a longitudinal through hole 118 of the joint block 106 and also into the recess 84. The mast screw 114 threadily engages the lock nut 82 to secure the lower mast piece 50 to the upper mast piece 48. The joint block 106 serves as a stabilizer and anti-rotation device since matching noncircular cross sections of the joint block 106 and mast prevent the lower mast piece 50 and upper mast piece 48 from rotating relative to each other and also lateral movement relative to each other.

As illustrated in FIGS. 2 and 3, the handle 16 includes a casing 120 that surrounds an interior space 122. Longitudinal grooves 121 are form on the exterior side 123 of the handle 16 and serve as a grip. A lateral mounting plate 124 (FIG. 3) is integrally formed in one piece with the casing 120 and extends across the interior space 122 of the handle 16. The mounting plate 124 includes a central longitudinal aperture 126. As seen in FIG. 2, the casing 120 includes a front end 128 that has a circular cross section at the exterior side 123 of the casing and a hexagonally shaped cross section at the interior side 130 of the casing that matches the hexagonal shape of the rear portion 64 of the boss 58. The front end 128 and rear portion 64 are sized such that the rear portion 64 of the boss 58 fits into and engages the interior side 130 of the front end 128. The rear portion 64 of the boss 58 serves as an anti-rotation device since its hexagonal shape matches that of the front end 128 to prevent rotation of the handle 16 relative to the mast 12 and nut block 18 about the longitudinal axis of the handle 16. A handle screw 132 connects the handle to the mast. In particular, the handle screw 132 extends through the interior space, aperture 126 of the mounting plate 124, aperture 60 of the boss, and lateral aperture 72 of the nut block. The handle screw 132 threadily engages the lock nut 74 to secure the handle 16 to the mast 12.

Figure 4A:
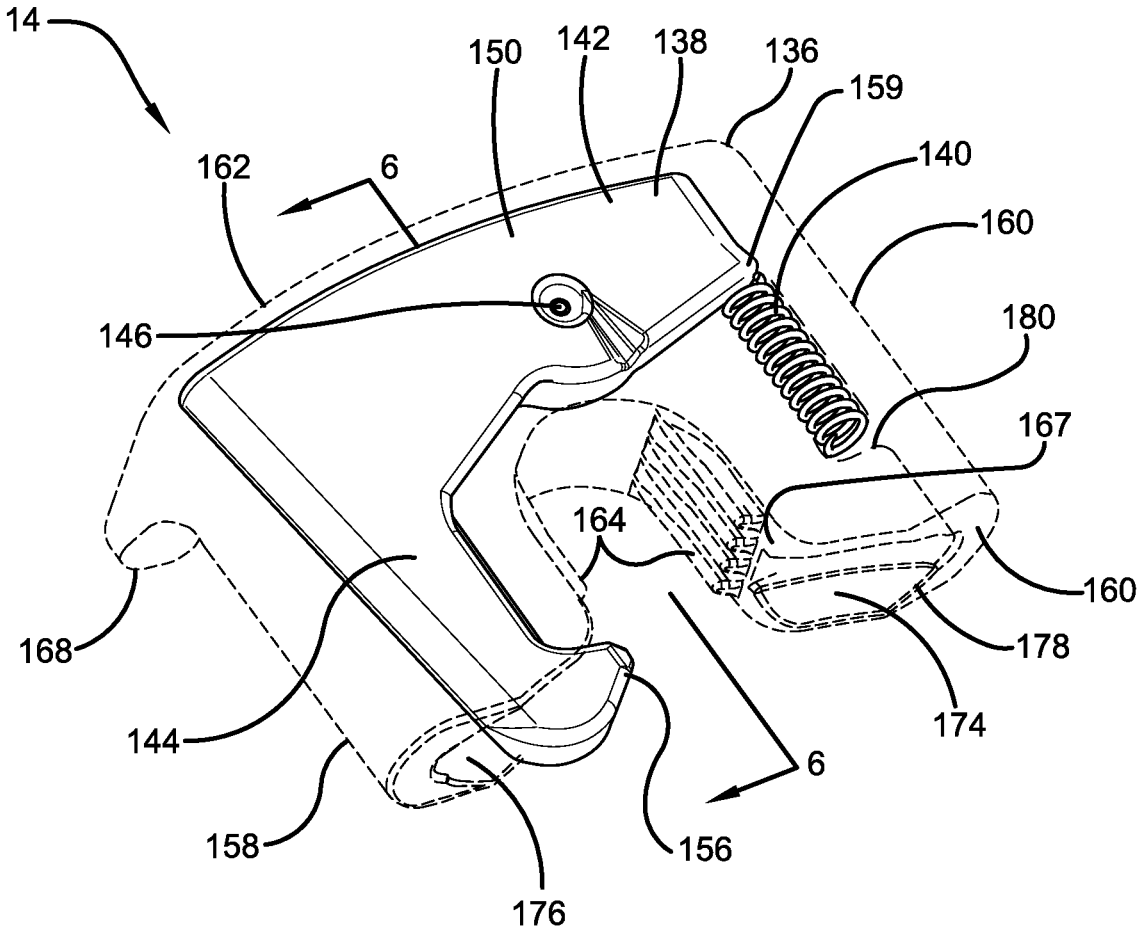
FIG. 4A is a top perspective view of the positioner assembly of the first embodiment of FIG. 1 in the latched position and with the housing of the positioner assembly shown in phantom lines to show the latch.
Figure 4B:
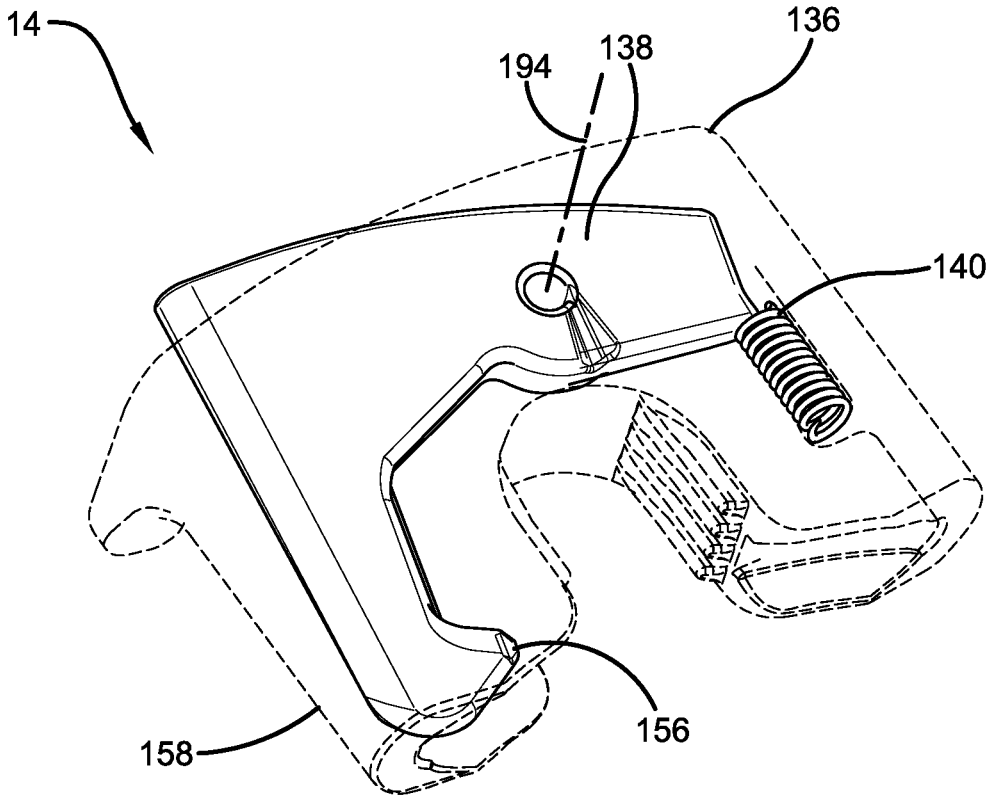
FIG. 4B is a view similar to FIG. 4A except that the latch is in the unlatch position.

Referring to FIGS. 4A, 4B, and 6, the positioner assembly 14 comprises a housing 136, a latch 138, and a biasing member such as a spring 140. The latch 138 is generally L-shaped and formed in one piece. The latch 138 comprises first and second arms 142, 144. The first arm 142 has a pair of top and bottom recesses 146, 148 (FIG. 6) located on opposite top and bottom sides 150, 152 of the first arm 142. As illustrated in FIG. 6, a grooved in ramp 154 is also located on the top side 150 of the first arm 142 rearwardly adjacent the top recess 146. The ramp 154 slopes downwardly and rearwardly from the top recess 146. The grooved in ramp 154 also narrows going in the forward direction. The second arm 142 has a hooked end 156 (FIGS. 4A and 4B).

The housing 136 is generally u-shaped and comprises rear first and second legs 158, 160 connected to each other by a bight portion 162. Lateral ribs 164 that define splines are molded on opposing first and second inner sides 166, 167 of the legs 158, 160. The housing ribs 164 are spaced from each other and extend from the top of the housing 136 to the bottom of the housing 136. The housing 136 includes a hook 168 that extends perpendicularly from a front end 170 (FIG. 2) of the housing 136. The hook 168 may be slightly convexly curved going from side to side along the front end 170 as illustrated in FIGS. 1 and 2. The hook 168 also has thick side ends that define spacers 172 (FIG. 1). The spacers 172 may also serve as stiffeners to provide stiffeners to the hook 168. The housing 136 includes a u-shaped compartment 174 that extends from a rear opened end 176 of the first leg 158 to a rear opened end 178 of the second leg 160. The second leg 160 includes a step 180 located inside the compartment 174 that faces forwardly. The bight portion 162 of the housing 136 has a front slot 182 (FIG. 2) that is sized to enable insertion of the second arm 144 of the latch 138 into and out of the housing 136.

As illustrated in FIG. 6, the bight portion 162 of the housing 136 also has a pair of opposing top and bottom projections 184, 186 located inside the compartment 174 that extend from their respective top and bottom walls 188, 190 of the compartment 174 towards each other. The projections define pivot pins 184, 186. The top and bottom pivot pins 184, 186 have beveled front ends 192, 193. The beveled front end 192 of the top pivot pin 184 slopes upwardly and forwardly and the beveled front end 193 of the bottom pivot pin 186 slopes downwardly and forwardly. The beveled front ends 192, 193 and the ramp 154 of the latch 138 act as a wedge to flex the top and bottom walls 188, 190 of the compartment 174 away from the latch 138 to allow the insertion of the latch 138 into the housing 136 until the pivot pins 184, 186 slide into their respective recesses 146, 148. Once the pins 184, 186 are in their respective recesses 146, 148, the top and bottom walls 188, 190 flex back to their original position to keep the pins in their respective recesses. The bottom wall 190 of the housing 136 has a generally flat exterior side 191 and the top wall 188 of the housing also has a completely flat exterior side 195. The exterior sides 191, 195 are opposite each other. The hook 168 extends from the exterior side 191 of the bottom wall 190.

The latch 138 is positioned in the compartment 174 and pivotally secured to housing 136. In particular, the first arm 142 is received in the bight portion 162 of the compartment 174 such that the first and second pivot pins 184, 186 are slidably received in their respective first and second recesses 146, 148. It should be noted that alternatively, the latch may comprise the pivot pins and the housing 136 may comprise the recesses that slidably receive the pivot pins. The second arm 144 of the latch 138 is located in the compartment 174 at the first leg 158 of the housing 136. The spring 140 is seated in the compartment at the second leg 160 of the housing 136 such that one end engages the step 180 and the other end engages the distal end 159 of the first arm 142 of the latch. The spring biases or urges the latch 138 in the latched position as shown in FIG. 4A. In the latched position, the hooked end 156 extends outside the housing 136. Pushing or otherwise applying a lateral outward force to the hooked end 156 that is sufficient to overcome the spring force on the hooked end 156 compresses the spring 140 and pivots the latch 138 relative to the housing 136 about a pivot axis 194 (FIGS. 4B and 5) in the counter clockwise direction (viewed in FIGS. 4A and 4B) until the hooked end 156 engages the housing 136 inside the compartment 174 as shown in FIG. 4B. In this unlatched position shown in FIG. 4B, a portion of the latch 138 extends through the front slot 182 and beyond the housing 136. The pivot axis 194 is parallel to the longitudinal axis 196 (FIG. 1) of the mast 12 when the positioner assembly 14 is attached to the mast 12. The pivot axis 194 is also located slightly closer to the second leg 160 of the housing 136 than the first leg 158 as illustrated in FIGS. 4A and 4B.

Referring to FIGS. 1 and 5, the positioner assembly 14 may be removably attached to the mast 12 at selected height locations. In particular, the positioner assembly 14 slidably receives the mast 12 in the u-shaped space between the legs 158, 160 when the positioner assembly 14 is attached to the mast 12. As illustrated in FIG. 5, when the positioner assembly 14 is attached to the mast 12, the ribs 164 of the positioner assembly 14 meshingly engage with corresponding ribs 46 on the mast 12 such that the positioner assembly 14 is prevented from moving along the mast 12. Also, when the positioner assembly 14 is attached to the mast 12, the latch 138 is in the latched position such that the hooked end 156 engages the outer rear side 24 of the mast 12 to hold the positioner assembly 14 to the mast 12 and prevent the removal of the positioner assembly 14 from the mast 12. To remove the positioner assembly 14 from the mast 12, a user pushes or otherwise applies a lateral outward force to the hooked end 156 that is sufficient to overcome the spring force on the hooked end 156 to pivot the latch 138 about the axis 194 in the counter clockwise direction (viewed in FIGS. 4A and 4B) until the hooked end 156 disengages from the mast 12. The compartment 174 at the second leg 160 is wide enough to provide sufficient space for the second arm 144 of the latch 138 to allow the hooked end 156 to move a sufficient distance to disengage from the mast 12. The positioner assembly 14 is then moved forwardly and slid off of the mast 12.

If a user desires to attach the positioner assembly 14 to the mast 12 at a different height, the positioner assembly 14 is positioned in front of the mast 12 at that height with the outer front side 26 of the mast 12 facing the u-shaped space. The positioner assembly 14 is moved rearwardly with sufficient force to overcome the biasing force of the spring 140 such that the mast 12 engages and moves the hooked end 156 away from the outer front side 26 of the mast 12 to allow the mast 12 to slide into the u-shaped space between the legs 158, 160 with the ribs 164 of the positioner assembly meshingly engaging the corresponding ribs 46 on the mast 12. The positioner assembly 16 is slid rearwardly until the hooked end 156 extends slightly beyond the outer rear side 24 of the mast 12. At that location, the mast 12 does not block the hook 168 from moving clockwise. Thus, the biasing force of the spring 140 pivots the latch 138 clockwise to the latched position such that the hooked end 156 engages the outer rear side 24 of the mast 12 to secure the positioner assembly 14 to the mast 12. As seen in FIG. 4A, the location of the pivot axis 194 causes the second arm 144 to angle more inwardly going in the rearward direction relative to the first leg 158. This in turn causes the hook 168 to catch or engage more of the perimeter of the mast 12 and also causes the latch 138 to impart more inward force against the mast 12. This results in a more secure latching of the positioner assembly 14 to the mast 12 and minimizes inadvertent removal of the positioner assembly 14 from the mast 12.

FIG. 7 shows a carton sizer 700 according to a second embodiment of the present invention. In this embodiment elements that are similar in function with the first embodiment of FIGS. 1-6, will be given the same references. This embodiment is similar to all aspects of the first embodiment, except that the mast 712 is shorter and comprised of one piece. Thus, the mast screw 114 joint block 106, lock nut 82, u-shaped upper end portion 80, and mounting plates 52, 66 are not a part of this embodiment.

Figure 8:
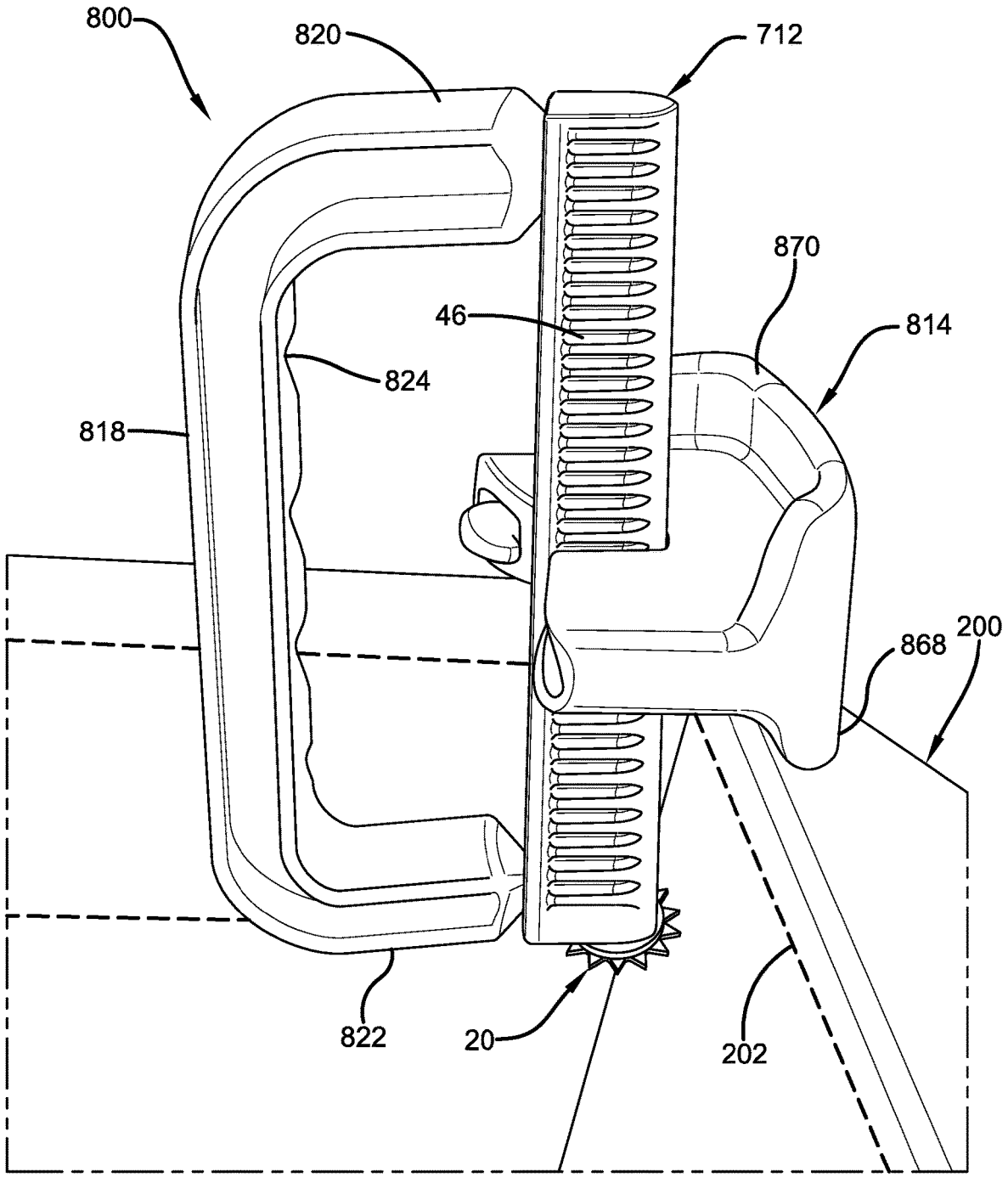
FIG. 8 is a left side perspective view of a third embodiment of the present invention and being used to cut a carton.

FIG. 8 shows a carton sizer 800 according to a third embodiment of the present invention. In this embodiment elements that are similar in function with the first and second embodiments of FIGS. 1-6 will be given the same reference numbers. This third embodiment is similar to that of the second embodiment shown in FIG. 7, except that the handle 816 is u-shaped and integrally formed in one piece with the mast 712 and the positioner assembly 814 has a second hook 870 extending in a direction opposite to that of the first hook 868. Also, the first hook 868 of this embodiment is shorter than the first hook 168 of the first and second embodiment. Specifically, the handle 816 includes a bight portion 818 that is interconnected between upper and lower legs 820, 822. The lower leg 822 is located just above the cutter assembly 20 and the upper leg 820 is located near the top of the mast 712. The bight portion 818 defines a grip portion that also includes grooves 824 for receiving the fingers of a user. The second hook 870 may have thicker spacers than the first hook at the side end as seen in FIG. 8. The second hook may be also be shorter or longer than the first hook. The positioner assembly 814 may be turned or flipped over and attached to the mast so that the second hook 870 extends downwardly and the first hook 816 extends upwardly. The positioner assembly 814 of the third embodiment may also be removably attached to the masts 12, 712 of the first and second embodiments, and the positioner assembly 14 of the first and second embodiment may also be removably attached to the mast 712 of the third embodiment.

In operation, a user attaches the positioner assembly 14 or 814 to the mast 12 or 712 at a desired height along the mast that corresponds to how much the carton 200 the user desires to be reduced. As shown in FIG. 1, the user may desire that the hook 168 be positioned so that it extends downwardly from the front end. The person grasps the handle 16 or 816 and positions the carton sizer such that the hook hooks over the top edge of the carton 200 (see FIG. 8) and the teeth 104 of the perforated disk 98 engage the inner side of the carton 200 (see FIGS. 7 and 8). The user pushes the carton sizer such that the teeth 104 press against the carton 200. The user then moves the carton sizer around the carton 200 such that the teeth 104 cut a perforated line 202 in the carton. The hook engages the outer side of the carton 200 to better support the carton sizer against the inner side and provide leverage for the user, so that the teeth 104 cut a perforated line 202 with less force by the user.

The positioner assembly 14 may also be turned or flipped over and attached to the mast 12, 712 such that the housing hook 168 extends upwardly, so that the flat side 195 of the housing 138 opposite the hook 168 engages the top edge of the carton as shown in FIG. 7. With this configuration, the positioner assembly 124 can be position at a very small height as shown in FIG. 7, since the hook 168 (at that small distance from the cutter assembly) does not contact the carton to inhibit the cutter assembly from reaching the cutting line of the carton 200 as the cutter assembly 20 moves to the cutting line of the carton 200. For example, a design that uses a set screw may have an effective working range of approximately 3-12 inches. By having the flat side 195, the range can be approximately ½-13 inches. The difference in the small end of the range is that their positioner runs into your hand, while the positioner assembly 14 of the present invention does not. So, for instance, if a carton only needed 2 inches removed from its height, the positioner of the present assembly can do this. By contrast, a design that uses a set crew cannot remove 2 inches from the carton.

Also, the positioner assembly 14 can move more smoothly around the corners, since the hook 168 does not contact the carton 200 and interfere with the movement of the positioner assembly 14. Upon perforation, the corners of the carton are cut from the perforation line 202 to the top. The flaps of the carton 200 can then be folded.

The mast, handle, and nut block may be made by liquid thermoset resin casting, injection molding, or 3-D printed. These components can be made components from a variety of thermoplastics such as Acrylonitrile Butadiene Styrene, Polycarbonate, Polyethylene Terephthalate Glycol, Recycled Polyethylene Terephthalate, etc. The cutter assembly and screws may be made of a stainless steel.

The carton sizer of the first embodiment may be assembled as follows. The positioner assembly 14 or 814 may be first assembled by inserting the spring 140 into the compartment 174 with one end of the spring bearing against the step 180. The latch 138 may then be inserted through the front slot 182 of the housing until the pivot pins 184, 186 slidably seat into their respective recesses 146, 148. The cutter assembly 20 may then be assembled to the nut block by inserting the machine screw 100 of the cutter assembly 20 through the perforated disk 98 and washers 102 and nut block 18 and threadily fastening the lock nut 78 onto the machine screw 100.

Then the lock nuts 74, 82 are placed on the nut block 18 and the nut block 18 is fitted securely into the lower mast piece 50. The axial ends 108, 110 of the joint block 106 are then inserted into their respective upper and lower mast pieces 48, 50. The mast screw 114 is then inserted through the through hole 118 of the joint block 106 and the apertures 56, 67 of the mounting plates 52, 66 and the lock nut is threadily fastened onto the mast screw 114 to secure the upper and lower mast pieces 48, 50 together. The rear portion 64 of the boss 58 is then fitted into the front end 128 of the handle 16 and the handle screw 132 is inserted through the apertures 126, 60 of the mounting plate 124 and the boss 58 and lateral aperture 72. The lock nut 74 is then threadily fastened to the handle screw 132 to secure the handle 16 to the mast 12.

The present invention provides an improved carton sizer with a versatile positioner assembly having the above-mentioned features. The positioner assembly is more securely attached to the mast than those carton sizers that use a set screw to attach a positioner. Also, a user does not have to exert as much effort to crank down on the set screw in order attach the positioner to the mast. The carton sizer has features in other elements as mentioned above. The present invention may include other features such as a tool carrying compartment in the housing of the positioner assembly or other portion of the carton sizer for carrying a knife blade to cut the carton, tape measure, perforating disk straightener or other tool.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

What is claimed is:

1. A positioner comprising:

a housing; and a latch, wherein the latch is connected to the housing, wherein the latch is movable between a latched position and an unlatched position, wherein the housing is configured to be removably attached to a mast of a carton sizer at a selected height along the mast, wherein the latch is configured to engage the mast in the latched position to hold the housing to the mast, wherein the latch is configured to disengage from the mast in the unlatched position, wherein the carton sizer includes a handle and a cutter, wherein the handle is connected to the mast, wherein the housing is configured to engage a carton to provide support for the cutter against the carton during the cutting of the carton, wherein the housing comprises first and second legs, wherein the first leg includes a first side, wherein the second leg includes a second side, wherein the first and second sides face each other, wherein each of the first and second sides includes housing ribs, wherein the mast includes mast ribs that extend along the mast, wherein one or more of the housing ribs is configured to meshingly engage a selected one or more of the mast ribs at the selected height to help removably secure the positioner to the mast.

2. The positioner of claim 1 further comprising a biasing member, wherein the housing houses the biasing member, wherein at least a portion of the latch is housed in the first leg, wherein the biasing member cooperates with the latch to urge the latch in the latched position.

3. The positioner of claim 1, wherein the housing further comprises a first hook, wherein the first hook is configured to engage the carton to provide support for the cutter against the carton during the cutting of the carton.

4. The positioner of claim 3, wherein the housing further comprises third and fourth sides, wherein the third and fourth sides are opposite each other, wherein the first hook extends from the third side, wherein the fourth side is flat, wherein the housing is configured to be positioned and removably attached to the mast such that the fourth side engages the carton to provide support for the cutter against the carton during the cutting of the carton.

5. The positioner of claim 3, wherein the housing further comprises a second hook, wherein the second hook extends in the opposite direction of the first hook, wherein the housing is configured to be positioned and removably attached to the mast such that the second hook engages the carton to provide support for the cutter against the carton during the cutting of the carton.

6. The positioner of claim 1, wherein the latch includes a hooked end, wherein the hooked end is configured to engage the mast in the latched position to hold the housing to the mast.

7. The positioner of claim 1, wherein the housing houses the latch, wherein the housing includes a slot, wherein the slot is configured to enable the latch to be inserted into the housing during an assembling of the positioner.

8. The positioner of claim 1, wherein the housing houses the latch, wherein the latch is pivotally connected to the housing, wherein the latch is pivoted between the latched position and the unlatched position.

9. A carton sizer comprising:

a handle;

a mast, wherein the handle is connected to the mast;

a cutter, wherein the cutter is in operative connection with the mast, wherein the cutter rotates relative to the mast; and a positioner, wherein the positioner comprises a housing and a latch, wherein the latch is connected to the housing, wherein the latch is movable between a latched position and an unlatched position, wherein the housing is removably attached to the mast at a selected height along the mast, wherein the latch engages the mast in the latched position to hold the housing to the mast, wherein the latch is disengaged from the mast in the unlatched position, wherein the housing is configured to engage a carton to provide support for the cutter against the carton during the cutting of the carton, wherein the housing has first and second legs, wherein the first leg includes a first side, wherein the second leg includes a second side, wherein the first and second sides face each other, wherein the each of the first and second sides includes housing ribs, wherein the mast includes mast ribs that extend along the mast, wherein one or more of the housing ribs meshingly engages a selected one or more of the mast ribs at the selected height to help removably secure the positioner to the mast.

10. The carton sizer of claim 9 further comprising a biasing member, wherein the housing houses the biasing member, wherein at least a portion of the latch is housed in the first leg, wherein the biasing member cooperates with the latch to urge the latch in the latched position.

11. The carton sizer of claim 9, wherein the housing further comprises a first hook, wherein the first hook is configured to engage the carton to provide support for the cutter against the carton during the cutting of the carton.

12. The carton sizer of claim 11, wherein the housing further comprises a second hook extending in the opposite direction of the first hook, wherein the housing is configured to be positioned and removably attached to the mast such that the second hook engages the carton to provide support for the cutter against the carton during the cutting of the carton.

13. The carton sizer of claim 9, wherein the mast includes a first piece and a second piece, wherein the first and second pieces are elongated, wherein the first piece and second piece are connected together by a joint block.

14. The carton sizer of claim 9, wherein the cutter is positioned on an end of the mast, wherein the mast has a first side, wherein the first side is convexly curved, wherein the cutter includes cutting teeth that extend beyond the first side.

15. The carton sizer of claim 9, wherein one of the handle and the mast has a female portion, wherein the other one of the mast and the handle has a male portion, wherein the female and male portions have matching non-circular cross sections, wherein the female portion receives the male portion such that rotation of the handle about a longitudinal axis defined by the handle relative to the mast is prevented.

16. The carton sizer of claim 9, wherein the latch includes a hooked end, wherein the hooked end is configured to engage the mast in the latched position to hold the housing to the mast.

17. The carton sizer of claim 9, wherein the housing houses the latch, wherein the latch is pivotally connected to the housing, wherein the latch is pivoted between the latched position and the unlatched position, wherein the latch pivots about an axis parallel to a longitudinal axis of the mast.

18. The carton sizer of claim 9, wherein the housing houses the latch, wherein the latch is pivotally connected to the housing, wherein the latch is pivoted between the latched position and the unlatched position.

* * * * *